US009100756B2

(12) United States Patent
Dusan et al.

(10) Patent No.: US 9,100,756 B2
(45) Date of Patent: Aug. 4, 2015

(54) MICROPHONE OCCLUSION DETECTOR

(71) Applicant: Apple Inc., Cupertino, CA (US)

(72) Inventors: Sorin V. Dusan, San Jose, CA (US); David T. Yeh, San Jose, CA (US); Aram M. Lindahl, Menlo Park, CA (US); Alexander Kanaris, San Jose, CA (US)

(73) Assignee: Apple Inc., Cupertino, CA (US)

( * ) Notice: Subject to any disclaimer, the term of this patent is extended or adjusted under 35 U.S.C. 154(b) by 350 days.

(21) Appl. No.: 13/715,422

(22) Filed: Dec. 14, 2012

(65) Prior Publication Data

US 2013/0329895 A1 Dec. 12, 2013

Related U.S. Application Data

(60) Provisional application No. 61/657,655, filed on Jun. 8, 2012, provisional application No. 61/700,265, filed on Sep. 12, 2012.

(51) Int. Cl.
*H04R 29/00* (2006.01)
*H04R 3/00* (2006.01)

(52) U.S. Cl.
CPC ..... *H04R 29/00* (2013.01); *H04R 29/004* (2013.01); *H04R 3/005* (2013.01); *H04R 2410/05* (2013.01); *H04R 2499/11* (2013.01)

(58) Field of Classification Search
None
See application file for complete search history.

(56) References Cited

U.S. PATENT DOCUMENTS 7,761,106 B2 * 7/2010 Konchitsky ..... 455/501
8,019,091 B2 9/2011 Burnett et al.
8,046,219 B2 10/2011 Zurek et al.
8,194,882 B2 6/2012 Every et al.
8,204,252 B1 6/2012 Avendano
8,204,253 B1 6/2012 Solbach
2007/0230712 A1 10/2007 Belt et al.
2007/0237339 A1 * 10/2007 Konchitsky ..... 381/91
2007/0274552 A1 * 11/2007 Konchitsky et al. ..... 381/328
2008/0201138 A1 8/2008 Visser et al.
2009/0190769 A1 * 7/2009 Wang et al. ..... 381/66
2009/0196429 A1 8/2009 Ramakrishnan et al.
2009/0220107 A1 9/2009 Every et al.
2010/0081487 A1 4/2010 Chen et al.
2011/0106533 A1 5/2011 Yu (Continued)

OTHER PUBLICATIONS

Non-Final Office Action (dated Jul. 31, 2014), U.S. Appl. No. 13/911,915, filed Jun. 6, 2014, First Named Inventor: Vasu Iyengar, 19 pages.

(Continued)

*Primary Examiner* — Brenda Bernardi
(74) *Attorney, Agent, or Firm* — Blakely, Sokoloff, Taylor & Zafman LLP

(57) ABSTRACT

Digital signal processing microphone occlusion detection is described that can be used with a noise suppression system that uses two types of noise estimators, including a more aggressive one based on two audio signals (such as for non-stationary noises) and a less aggressive one based on one audio signal (such as for stationary noises). Decisions are made on how to select or combine the outputs of the noise estimators into a usable noise estimate, based on an occlusion function. The occlusion detection may alternatively be used to trigger an alert to users of multi-microphone audio processing systems, such as smart phones, headsets, laptops and tablet computers. Other embodiments are also described and claimed.

25 Claims, 7 Drawing Sheets

(56) References Cited

U.S. PATENT DOCUMENTS

| | | | | |
|---|---|---|---|---|
| 2011/0317848 | A1 | 12/2011 | Ivanov et al. | |
| 2012/0121100 | A1 | 5/2012 | Zhang et al. | |
| 2012/0185246 | A1 | 7/2012 | Zhang et al. | |
| 2012/0310640 | A1 * | 12/2012 | Kwatra et al. | 704/233 |
| 2013/0054231 | A1 | 2/2013 | Jeub | |
| 2014/0126745 | A1 * | 5/2014 | Dickins et al. | 381/94.3 |

OTHER PUBLICATIONS

Schwander, Teresa, et al.,"Effect of Two-Microphone Noise Reduction on Speech Recognition by Normal-Hearing Listeners*", Journal of Rehabilitation Research and Development, vol. 24, No. 4, Fall 1987, (pp. 87-92).

Jeub, Marco, et al., "Noise Reduction for Dual-Microphone Mobile Phones Exploiting Power Level Differences", Acoustics, Speech and Signal Processing (ICASSP), 2012 IEEE International Conference, Mar. 25-30, 2012, ISSN: 1520-6149, E-ISBN: 978-1-4673-0044-5, (pp. 1693-1696).

Tashev, Ivan, et al., "Microphone Array for Headset with Spatial Noise Suppressor", Microsoft Research, One Microsoft Way, Redmond, WA, USA, in Proceedings of Ninth International Workshop on Acoustics, Echo and Noise Control, Sep. 2005, (4 pages).

Verteletskaya, Ekaterina, et al., "Noise Reduction Based on Modified Spectral Subtraction Method", IAENG International Journal of Computer Science, 38:1, IJCS_38_1_10, (Advanced online publication: Feb. 10, 2011), (7 pages).

Widrow, Bernard, et al., "Adaptive Noise Cancelling: Principles and Applications", Proceedings of the IEEE, vol. 63, No. 12, Dec. 1975, ISSN: 0018-9219, (pp. 1962-1716,and 1 additional page).

* cited by examiner

MICROPHONE OCCLUSION DETECTOR

This non-provisional application claims the benefit of the earlier filing date of provisional application No. 61/657,655 filed Jun. 8, 2012, and provisional application No. 61/700,265 filed Sep. 12, 2012.

FIELD

An embodiment of the invention is related to digital signal processing techniques for automatically detecting that a first microphone has been occluded, and using such a finding to modify a noise estimate that is being computed based on signals from the first microphone and from a second microphone. Other embodiments are also described.

BACKGROUND

Mobile phones enable their users to conduct conversations in many different acoustic environments. Some of these are relatively quiet while others are quite noisy. There may be high background or ambient noise levels, for instance, on a busy street or near an airport or train station. To improve intelligibility of the speech of the near-end user as heard by the far-end user, an audio signal processing technique known as ambient noise suppression can be implemented in the mobile phone. During a mobile phone call, the ambient noise suppressor operates upon an uplink signal that contains speech of the near-end user and that is transmitted by the mobile phone to the far-end user's device during the call, to clean up or reduce the amount of the background noise that has been picked up by the primary or talker microphone of the mobile phone. There are various known techniques for implementing the ambient noise suppressor. For example, using a second microphone that is positioned and oriented to pickup primarily the ambient sound, rather than the near-end user's speech, the ambient sound signal is electronically subtracted from the talker signal and the result becomes the uplink. In another technique, the talker signal passes through an attenuator that is controlled by a voice activity detector, so that the talker signal is attenuated during time intervals of no speech, but not in intervals that contain speech. A challenge is in how to respond when one of the microphones is occluded, e.g. by accident when the user covers one with her finger.

SUMMARY

An electronic audio processing system is described that uses multiple microphones, e.g. for purposes of noise estimation and noise reduction. A microphone occlusion detector generates an occlusion signal, which may be used to inform the calculation of a noise estimate. In particular, the occlusion detection may be used to select a 1-mic noise estimate, instead of a 2-mic noise estimate, when the occlusion signal indicates that a second microphone is occluded. This helps maintain proper noise suppression even when a user's finger has inadvertently occluded the second microphone, during speech activity, and during no speech but high background noise levels. To accommodate situations where there is both no speech activity and low or middle background noise levels, a compound occlusion detector is described. The microphone occlusion detectors may also be used with other audio processing systems that rely on the signals from at least two microphones.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
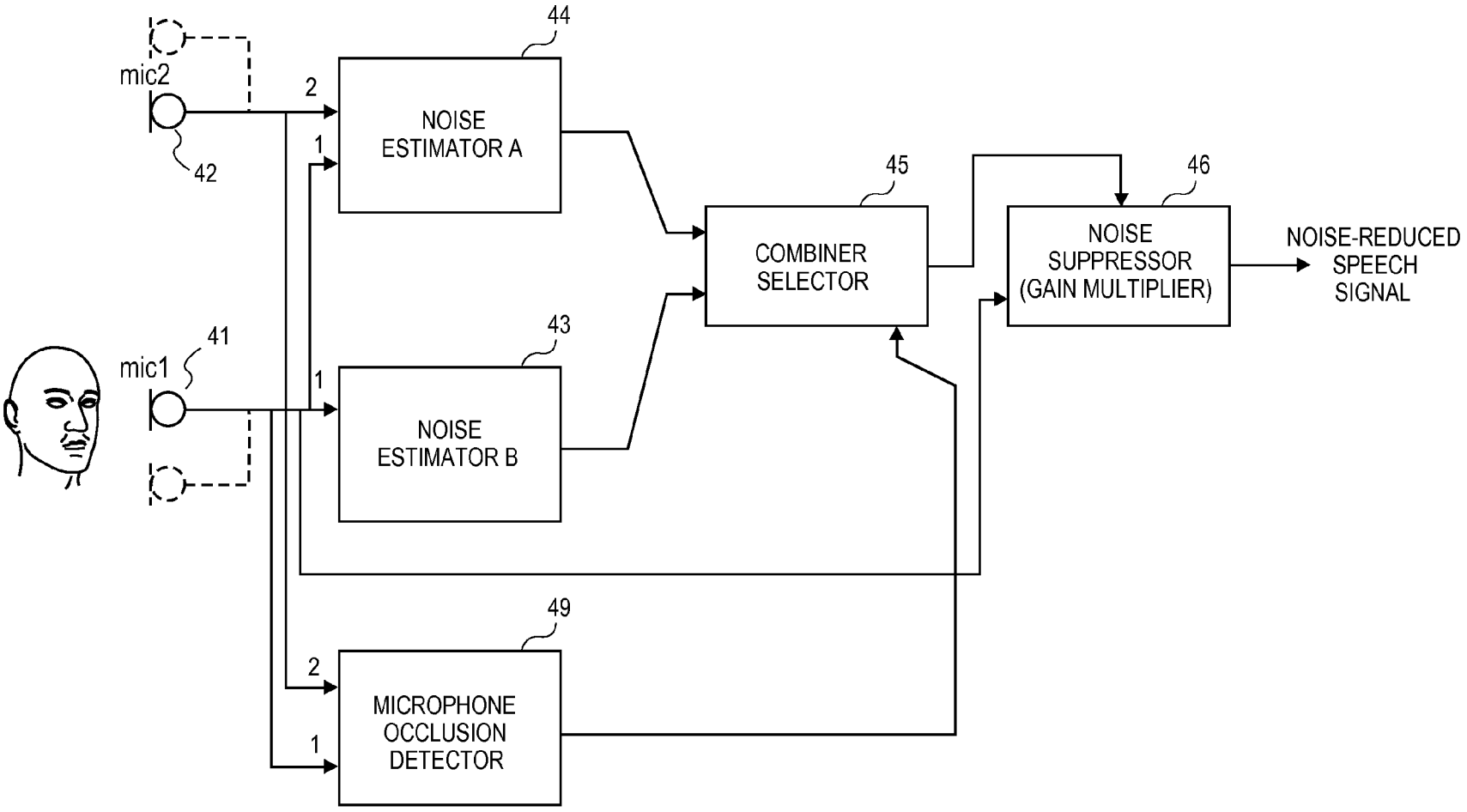
FIG. 1 is a block diagram of an electronic system for audio noise processing and noise reduction using multiple microphones.

FIG. 1 is a block diagram of an electronic system for audio noise processing and noise reduction using multiple microphones. In one embodiment, the functional blocks depicted in FIG. 1 as well as in FIG. 3A (which is described further below) refer to programmable digital processors or hardwired logic processors that operate upon digital audio streams. In this example, there are two microphones 41, 42 that produce the digital audio streams. The microphone 41 (mic1) may be a primary microphone or talker microphone, which is closer to the desired sound source than the microphone 42 (mic2). The latter may be referred to as a secondary microphone, and is in most instances located farther away from the desired sound source than mid. Examples of such microphones may be found in a variety of different user audio devices. An example is the mobile phone—see FIG. 5. Both microphones 41, 42 are expected to pick up some of the ambient or background acoustic noise that surrounds the desired sound source albeit mic1 is expected to pick up a stronger version of the desired sound. In one case, the desired sound source is the mouth of a person who is talking thereby producing a speech or talker signal, which is also corrupted by the ambient acoustic noise.

There are two audio or recorded sound channels shown, for use by various component blocks of the noise reduction (also referred to as noise suppression) system. Each of these channels carries the audio signal from a respective one of the two microphones 41, 42. It should be recognized however that a single recorded (or digitized) sound channel could also be obtained by combining the signals of multiple microphones, such as via beamforming. This alternative is depicted in the figure by the additional microphones and their connections in dotted lines. It should also be noted that in one approach, all of the processing depicted in FIG. 1 is performed in the digital domain, based on the audio signals in the two channels being discrete time sequences. Each sequence of audio data may be arranged as a series of frames, where all of the frames in a given sequence may or may not have the same number of samples.

A pair of noise estimators 43, 44 operate in parallel to generate their respective noise estimates, by processing the two audio signals from mic1 and mic2. The noise estimator 43 is also referred to as noise estimator B, whereas the noise estimator 44 can be referred to as noise estimator A. In one instance, the estimator A performs better than the estimator B in that it is more likely to generate a more accurate noise estimate, while the microphones are picking up a near-end-user's speech and non-stationary background acoustic noise during a mobile phone call.

In one embodiment, for stationary noise, such as noise that is heard while riding in a car (which may include a combination of exhaust, engine, wind, and tire noise), the two estimators A, B should provide, for the most part, similar estimates. However, in some instances there may be more spectral detail provided by the estimator A, which may be due to a better voice activity detector, VAD, being used, as described further below, and the ability to estimate noise even during speech activity. On the other hand, when there are significant transients in the noise, such as babble (e.g., in a crowded room) and road noise (that is heard when standing next to a road on which cars are driving by), the estimator A can be more accurate in that case because it is using two microphones. That is because in estimator B, some transients could be interpreted as speech, thereby excluding them (erroneously) from the noise estimate.

In another embodiment, the noise estimator B is primarily a stationary noise estimator, whereas the noise estimator A can do both stationary and non-stationary noise estimation because it uses two microphones.

In yet another embodiment, estimator A may be deemed more accurate in estimating non-stationary noises than estimator B (which may essentially be a stationary noise estimator). Estimator A might also misidentify more speech as noise, if there is not a significant difference in voice power between a primarily voice signal at mic1 (41) and a primarily noise signal at mic2 (42). This can happen, for example, if the talker's mouth is located the same distance from each microphone. In a preferred embodiment of the invention, the sound pressure level (SPL) of the noise source is also a factor in determining whether estimator A is more accurate than estimator B—above a certain (very loud) level, estimator A may be less accurate at estimating noise than estimator B. In another instance, the estimator A is referred to as a 2-mic estimator, while estimator B is a 1-mic estimator, although as pointed out above the references 1-mic and 2-mic here refer to the number of input audio channels, not the actual number of microphones used to generate the channel signals.

The noise estimators A, B operate in parallel, where the term "parallel" here means that the sampling intervals or frames over which the audio signals are processed have to, for the most part, overlap in terms of absolute time. In one embodiment, the noise estimate produced by each estimator A, B is a respective noise estimate vector, where this vector has several spectral noise estimate components, each being a value associated with a different audio frequency bin. This is based on a frequency domain representation of the discrete time audio signal, within a given time interval or frame. A combiner-selector 45 receives the two noise estimates and generates a single output noise estimate. In one instance, the combiner-selector 45 combines, for example as a linear combination, its two input noise estimates to generate its output noise estimate. However, in other instances, the combiner-selector 45 may select the input noise estimate from estimator A, but not the one from estimator B, and vice-versa.

The noise estimator B may be a conventional single-channel or 1-mic noise estimator that is typically used with 1-mic or single-channel noise suppression systems. In such a system, the attenuation that is applied in the hope of suppressing noise (and not speech) may be viewed as a time varying filter that applies a time varying gain (attenuation) vector, to the single, noisy input channel, in the frequency domain. Typically, such a gain vector is based to a large extent on Wiener theory and is a function of the signal to noise ratio (SNR) estimate in each frequency bin. To achieve noise suppression, frequency bins with low SNR are attenuated while those with high SNR are passed through unaltered, according to a well know gain versus SNR curve. Such a technique tends to work well for stationary noise such as fan noise, far field crowd noise, car noise, or other relatively uniform acoustic disturbance. Non-stationary and transient noises, however, pose a significant challenge, which may be better addressed by the noise estimation and reduction system depicted in FIG. 1 which also includes the estimator A, which may be a more aggressive 2-mic estimator. In general, the embodiments of the invention described here as a whole may aim to address the challenge of obtaining better noise estimates, both during noise-only conditions and noise+speech conditions, as well as for noises that include significant transients.

Still referring to FIG. 1, the output noise estimate from the combiner-selector 45 is used by a noise suppressor (gain multiplier/attenuator) 46, to attenuate the audio signal from microphone 41. The action of the noise suppressor 46 may be in accordance with a conventional gain versus SNR curve, where typically the attenuation is greater when the noise estimate is greater. The attenuation may be applied in the frequency domain, on a per frequency bin basis, and in accordance with a per frequency bin noise estimate which is provided by the combiner-selector 45.

Each of the estimators 43, 44, and therefore the combiner-selector 45, may update its respective noise estimate vector in every frame, based on the audio data in every frame, and on a per frequency bin basis. The spectral components within the noise estimate vector may refer to magnitude, energy, power, energy spectral density, or power spectral density, in a single frequency bin.

One of the use cases of the user audio device is during a mobile phone call, where one of the microphones, in particular mic2, can become occluded, due to the user's finger for example covering an acoustic port in the housing of the handheld mobile device. As a result, the 2-mic noise estimator A used in the suppression system of FIG. 1 will provide a very small noise estimate, which may not correspond with the actual background noise level. Therefore, at that point, the system should automatically switch to or rely more strongly on the 1-mic estimator B (instead of the 2-mic estimator A). This may be achieved by adding a microphone occlusion detector 49 whose output generates a microphone occlusion signal that represents a measure of how severely, or how likely it is that, one of the microphones is occluded. The combiner-selector 45 is modified to respond to the occlusion signal by accordingly changing its output noise estimate. For example, the combiner-selector 45 selects the first noise estimate (1-mic estimator B) for its output noise estimate, and not the second noise estimate (2-mic estimator A), when the occlusion signal crosses a threshold indicating that the second one of the microphones (here, mic 42) is occluded or is more occluded. The combiner-selector 45 can return to selecting the 2-mic estimator A for its output, once the occlusion has been removed, with the understanding that a different occlusion signal threshold may be used in that case (so as to employ hysteresis corresponding to a few dBs for instance) to avoid oscillations.

In one embodiment of the invention, in the microphone occlusion detector 49, the first and second audio signals from mic1 and mic2, respectively, are processed to compute a power or energy ratio (generically referred to here as "PR"), such as in dB, of two microphone output (audio) signals $x_1$ and $x_2$. An occlusion function is then evaluated that is a function of PR, e.g. at the computed PR itself or a smoothed version of it—see FIG. 2, which shows three different occlusion functions 61, 62 and 63. Other types of occlusion functions can be employed by those of ordinary skill in the art. Generally speaking, the occlusion function represents a measure of how severely or how likely it is that one of the first and second microphones is occluded, using the processed first and second audio signals. Note however that for a more complete characterization of the occlusion of mic2, the combiner-selector 45 may also compute and use the following additional terms when determining the severity of occlusion: absolute power of the second audio signal (mic 2), such as integrated over an entire frame; the output noise estimate; and a voice activity detection indicator.

In one embodiment, the power ratio may be computed using the formula $$PR=pow1t-pow2t(\text{or power ratio in dB})$$

$$pow1t=10*\log 10\{[\text{summation of frame_mic1}(i)*\text{frame_mic1}(i)]/N\},$$

$$pow2t=10*\log 10\{[\text{summation of frame_mic2}(i)*\text{frame_mic2}(i)]/N\}$$

where frame_mic1 includes samples from i=1 to i=N (e.g., 256 time samples) of a band pass filtered audio signal from mid, and frame_mic2 includes samples from i=1 to i=N (e.g., 256 time samples) of a band pass filtered audio signal from mic2 (obtained in parallel). Note that the PR may also be computed as an energy ratio in the frequency domain by summing the power in frequency bins between the beginning and end of the band pass filter being used. Computing the power or energy ratio from band pass filtered signals, such as between 2000 Hz and 4000 Hz, provides more robust occlusion detection than using the entire audio frequency band. This is because microphone occlusion effects, e.g. signal attenuations, are stronger in those higher frequencies, than at lower frequencies, namely substantially below 2 kHz).

Figure 2:
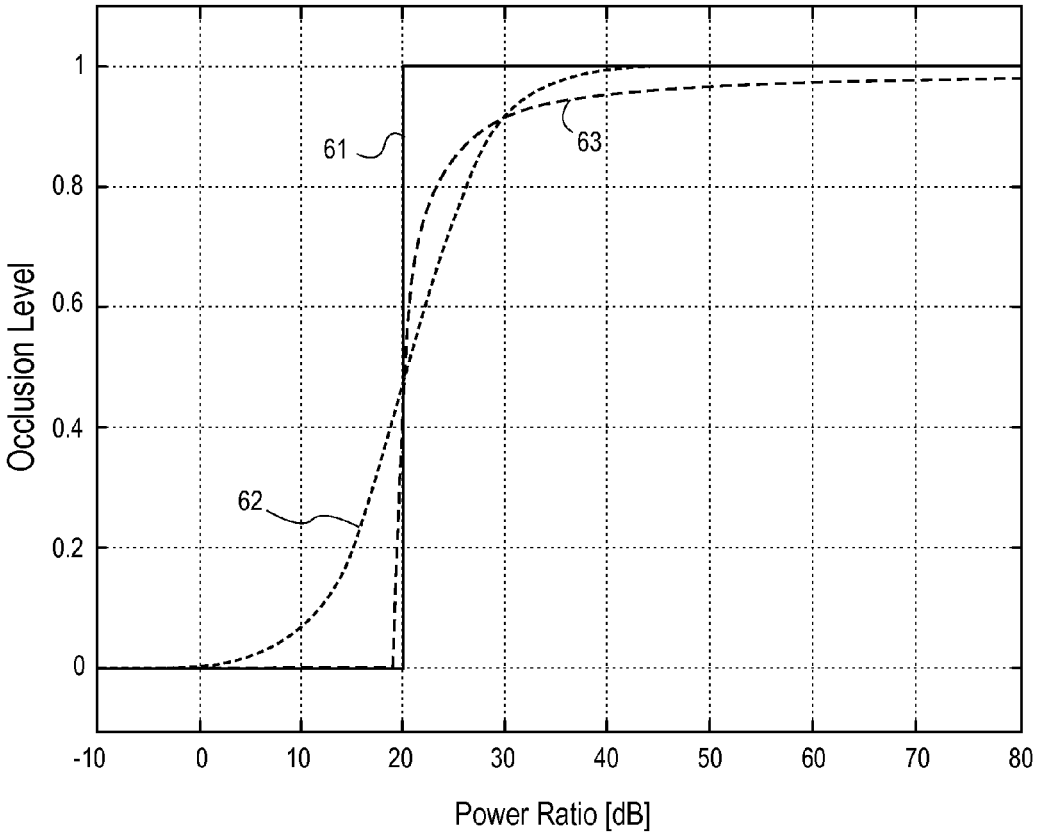
FIG. 2 shows plots of several occlusion function curves.

The occlusion function may be determined based on the phone form factor, as follows. In one example, when a mobile phone is being held in a normal handset position (against the ear), for clean speech, a base value of F dB is computed for the PR while mic2 is not obstructed. The F base value could be for example 12.5 dB for a given phone. A threshold value for PR is selected that should be a few dB higher than F. The exact number can be empirically selected based on experimentation involving different actual occlusion conditions of the microphone and their associated computed PR values. As shown in FIG. 2, this PR threshold value defines an inflection point of the occlusion function at a value of 0.5 (in the case of a scale 0-1 as used here).

In one embodiment, the occlusion function is defined as a step function (an abrupt function for example jumping from 0 to 1)—it may indicate one fixed value (e.g., 1=occluded) when the PR is greater than a threshold inflection point, and another fixed value (e.g., 0=not occluded) when the PR is less than the threshold. This is depicted by an example, as curve 61 in FIG. 2. This curve presents relatively low computational complexity. In contrast, FIG. 2 also shows a slightly more complex curve for the occlusion function, namely curve 63, which abruptly indicates no occlusion when PR goes below the threshold, but gradually indicates occlusion when PR rises above the threshold (with the understanding here that "the threshold" may encompass some hysteresis). In the example shown, the curve 63 may be defined as follows: 0 when PR<19 dB; and (PR−19)/(1+PR−19) when PR>19. This occlusion detection function intersects the other curve 61 at the threshold PR=20 dB, where its value is also 0.5 (the same as the other curve 61).

Still referring to FIG. 2, a further occlusion function is shown as curve 62, which is proportional to a logistic function C/(1+A*exp(−B*PR)) where A, B and C are scalar coefficients that define the slope, position and final magnitude of the logistic function. The logistic function has an inflection point at PRi=ln(A)/B, where its value is 0.5 and ln represents the natural logarithm. This is more computationally complex than the other curves 61, 63 but it provides a smoother response. By setting A, B and C so that the inflection point is at the desired PR threshold (here, about 20 dB, obtained by setting A=150, B=0.25 and C=1), the occlusion function indicates an occlusion of mic2 in the following situation: there is speech activity while mic2 output is attenuated due to occlusion by at least 7.5 dB relative to when mic2 is un-occluded (during speech); this causes the logistic function to go "past" or above its inflection point, meaning more occlusion. Of course, the numbers given here relating to the inflection point are just examples that are specific to one scenario; the concepts here are applicable more broadly. The computation of the occlusion function is restricted to a frequency sub-band, for example 2000 Hz-4000 Hz.

In one embodiment, after the PR (or magnitude ratio MR) is computed, in time or frequency domain, the occlusion function is evaluated by smoothing the logistic function (LF) in time using for example an exponential filter as follows: LF(t)=alpha*LF(t−1)+(1−alpha)*PR(t) where alpha is a smoothing factor between 0 and 1. A similar expression holds when using MR(t), instead of PR(t).

An advantage of using occlusion detection in the context of noise suppression is to switch from the 2-mic noise estimator to the 1-mic noise estimator, so that the background noise is still attenuated properly during speech activity, despite a high power ratio PR (due to mic2 being occluded) which would normally be interpreted as signaling a low ambient noise level. In addition, switching to the 1-mic noise estimator in the absence of speech activity but during significant background noise allows this noise to be attenuated, again despite the high power ratio PR (which is due to mic2 being occluded).

The above described occlusion detection works well so long as there is a) speech activity with no background noise, b) speech with little to significant background noise, or c) no speech activity but significant background noise. In the particular numerical example given above, where there is no speech but there is high background noise, the logistic function (curve 62) can still detect occlusion, but only if the signal from mic2 is significantly attenuated, in particular at least 20 dB relative to mid. However, this configuration of the logistic function may not be able to detect occlusion in situations where there is no speech and essentially no background noise (in other words, a noise-only condition with just low and mid noise levels), as the PR in that case simply cannot go high enough to reach the threshold point of 20 dB. A solution here is to add another detector in parallel, which results in a "compound" occlusion detector as described below.

Figure 3A:
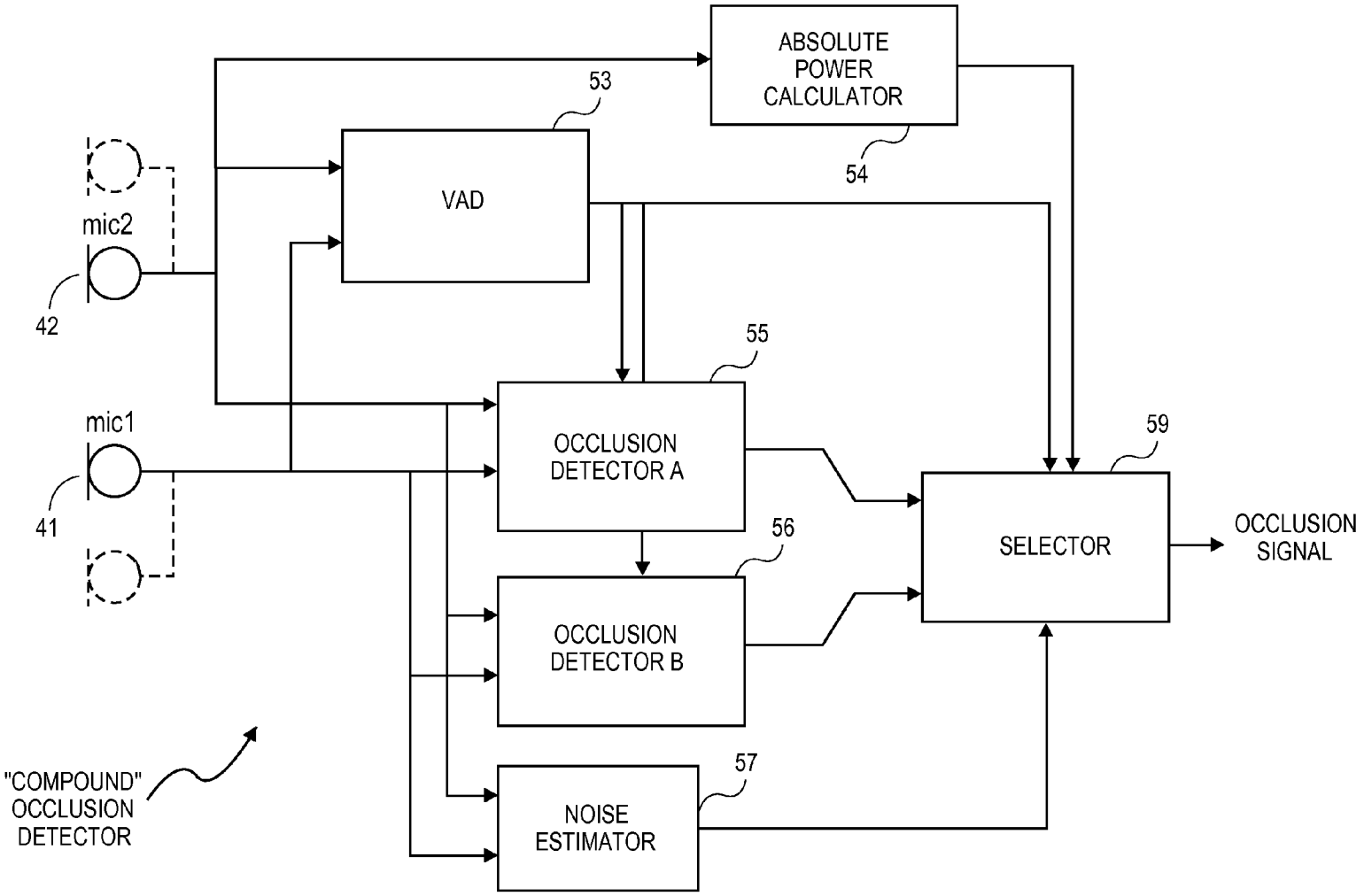
FIG. 3A is a block diagram of a compound occlusion detector.

Referring now to FIG. 3A, a microphone occlusion detector that uses multiple occlusion component functions is shown. In this example, a voice activity detector (VAD) 53 processes the first and second audio signals that are from mic1 and mic2, respectively, to generate a VAD decision. A first occlusion component function is evaluated by the occlusion detector A, that represents a measure of how severely or how likely it is that and the second microphone (mic 2) is occluded, when the VAD decision is 0 (no speech is present). A second occlusion component function that represents a measure of how severely or how likely it is that the second microphone is occluded when the VAD decision is 1 (speech is present), is also evaluated. The selector 59 picks between the first and second occlusion component signals as a function of the levels of speech and background noise being picked up by the microphones, e.g. as reported by the VAD 53 and/or as indicated by computing the absolute power of the signal from mic2 (absolute power calculator 54), and/or by a background noise estimator 57.

Figure 3B:
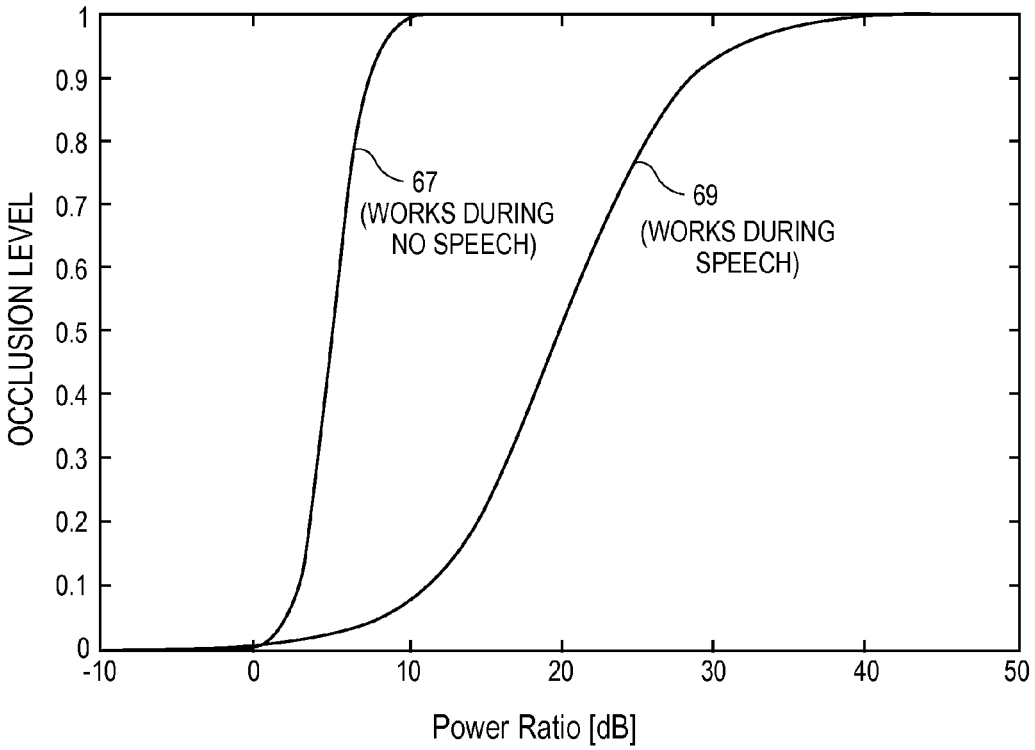
FIG. 3B shows plots of occlusion function curves used in a compound occlusion detector.

The occlusion detectors A, B may have different thresholds (inflection points), so that one of them is better suited to detect occlusions in a no speech condition in which the level of background noise is at a low or mid level, while the other can better detect occlusions in either a) a no speech condition in which the background noise is at a high level or b) in a speech condition. The former detector would be more sensitive to noise and would have a lower PR threshold, e.g. somewhere between 0 dB and substantially less than 20 dB, while the latter would have a higher PR threshold, e.g. around 20 dB. Examples of the occlusion functions that may be evaluated by such detectors are shown in FIG. 3B. The curve 67 is in the lower threshold detector (e.g., detector A of FIG. 3A) used during noise (VAD=0), while the curve 69 is in the higher threshold detector (detector B of FIG. 3A) used during speech (VAD=1).

Figure 4:
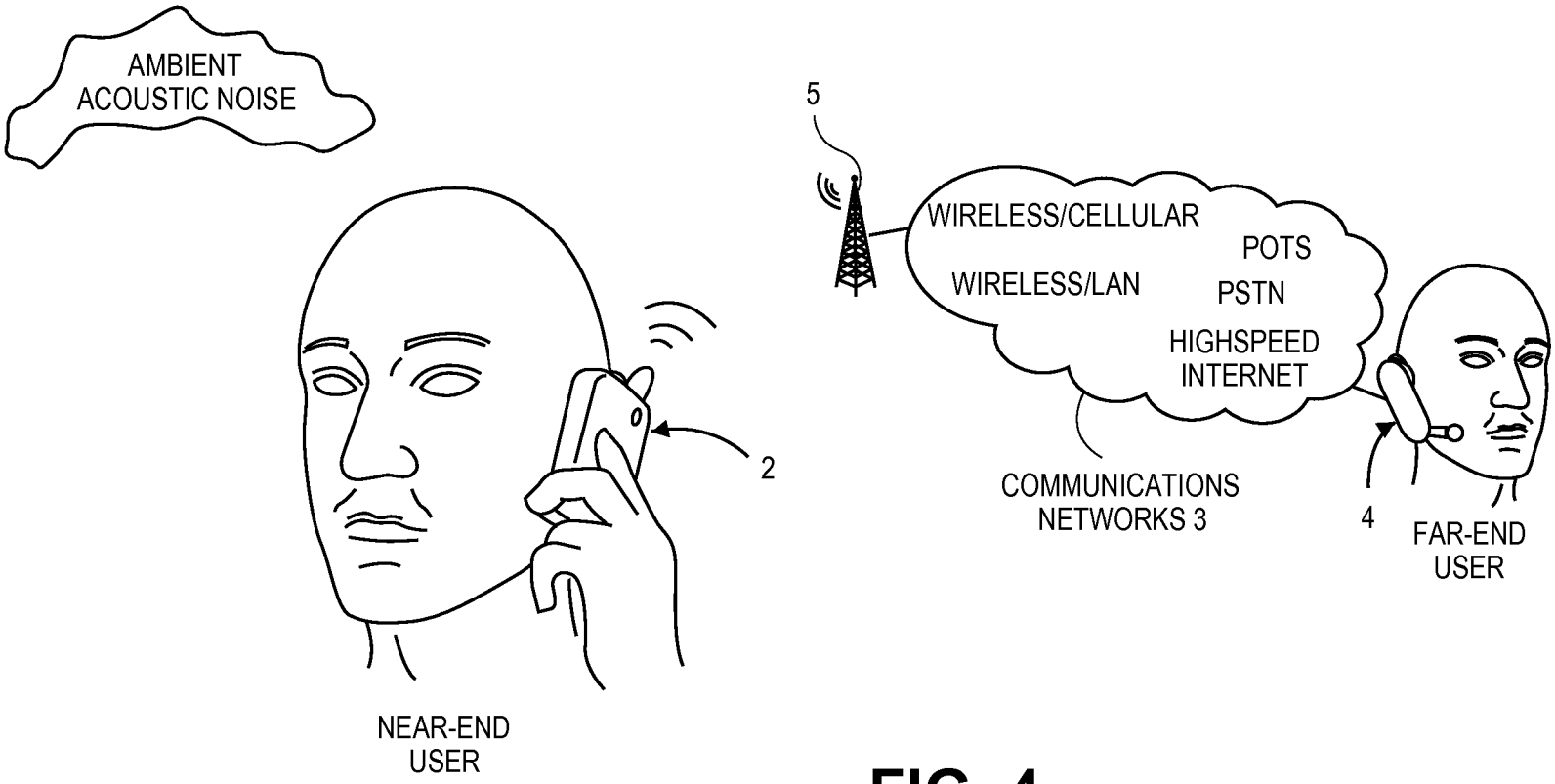
FIG. 4 depicts a mobile communications handset device in use at-the-ear during a call, by a near-end user in the presence of ambient acoustic noise.

FIG. 4 shows a near-end user holding a mobile communications handset device 2 such as a smart phone or a multi-function cellular phone. The noise estimation, occlusion detection and noise reduction or suppression techniques described above can be implemented in such a user audio device, to improve the quality of the near-end user's recorded voice. The near-end user is in the process of a call with a far-end user who is using a communications device 4. The terms "call" and "telephony" are used here generically to refer to any two-way real-time or live audio communications session with a far-end user (including a video call which allows simultaneous audio). The term "mobile phone" is used generically here to refer to various types of mobile communications handset devices (e.g., a cellular phone, a portable wireless voice over IP device, and a smart phone). The mobile device 2 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

Figure 5:
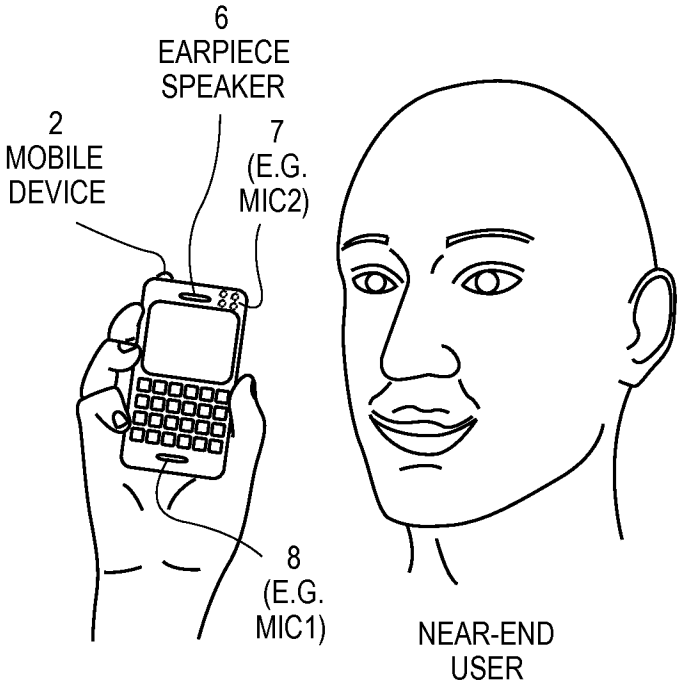
FIG. 5 depicts the user holding the mobile device away-from-the-ear during a call.

As seen in FIG. 5, the mobile device 2 has an exterior housing in which are integrated an earpiece speaker 6 near one side of the housing, and a primary microphone 8 (also referred to as a talker microphone, e.g. mic 1) that is positioned near an opposite side of the housing. The mobile device 2 may also have a secondary microphone 7 (e.g., mic 2) located on another side or on the rear face of the housing and generally aimed in a different direction than the primary microphone 8, so as to better pickup the ambient sounds. The latter may be used by an ambient noise suppressor 24 (see FIG. 6), to reduce the level of ambient acoustic noise that has been picked up inadvertently by the primary microphone 8 and that would otherwise be accompanying the near-end user's speech in the uplink signal that is transmitted to the far-end user.

Figure 6:
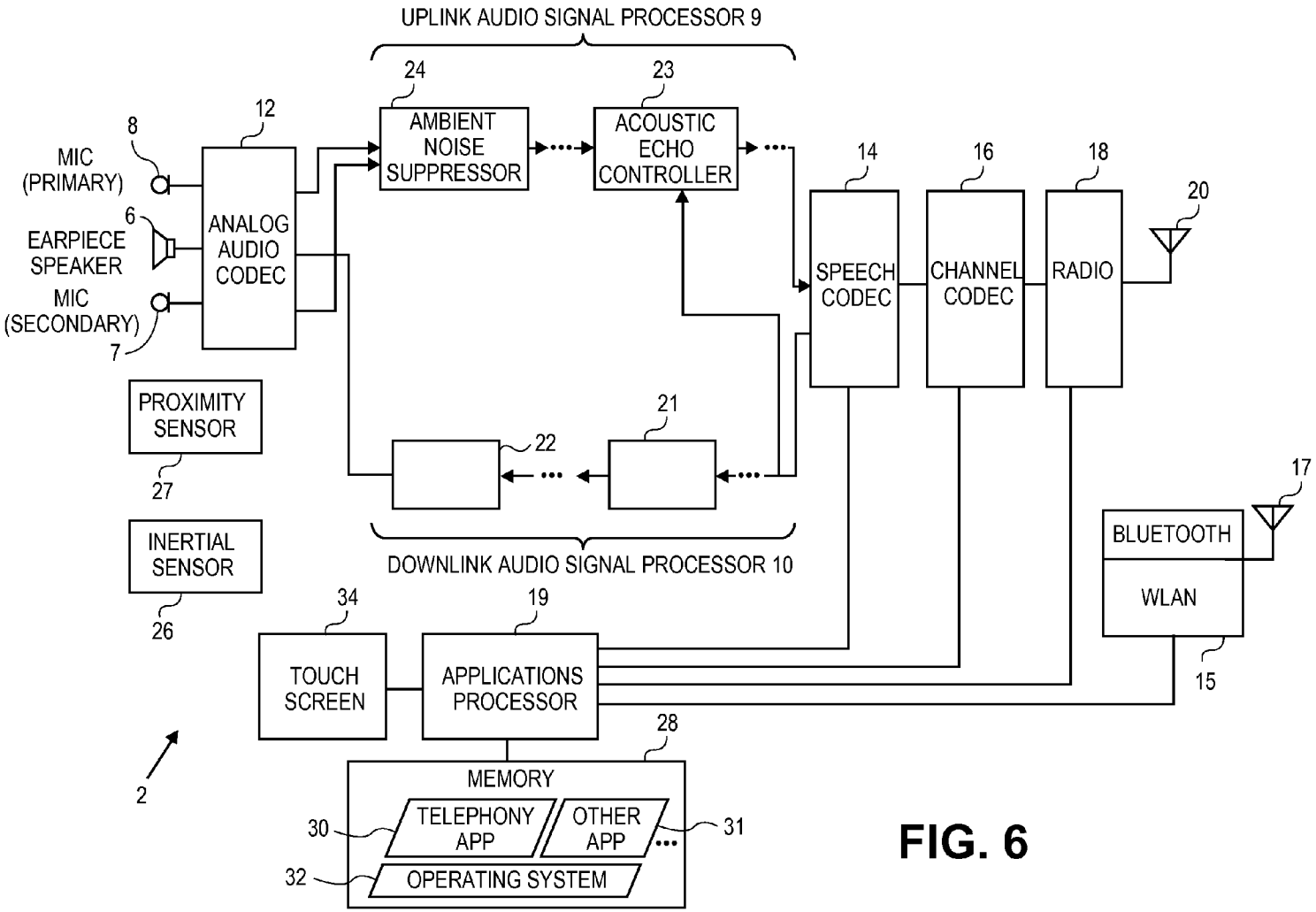
FIG. 6 is a block diagram of some of the functional unit blocks and hardware components in an example mobile device.

Turning now to FIG. 6, a block diagram of some of the functional unit blocks of the mobile device 2, relevant to the call enhancement process described above concerning ambient noise suppression, is shown. These include constituent hardware components such as those, for instance, of an iPhone™ device by Apple Inc. Although not shown, the device 2 has a housing in which the primary mechanism for visual and tactile interaction with its user is a touch sensitive display screen (touch screen 34). As an alternative, a physical keyboard may be provided together with a display-only screen. The housing may be essentially a solid volume, often referred to as a candy bar or chocolate bar type, as in the iPhone™ device. Alternatively, a moveable, multi-piece housing such as a clamshell design or one with a sliding physical keyboard may be provided. The touch screen 34 can display typical user-level functions of visual voicemail, web browser, email, digital camera, various third party applications (or "apps"), as well as telephone features such as a virtual telephone number keypad that receives input from the user via touch gestures.

The user-level functions of the mobile device 2 are implemented under the control of an applications processor 19 or a system on a chip (SoC) that is programmed in accordance with instructions (code and data) stored in memory 28 (e.g., microelectronic non-volatile random access memory). The terms "processor" and "memory" are generically used here to refer to any suitable combination of programmable data processing components and data storage that can implement the operations needed for the various functions of the device described here. An operating system 32 may be stored in the memory 28, with several application programs, such as a telephony application 30 as well as other applications 31, each to perform a specific function of the device when the application is being run or executed. The telephony application 30, for instance, when it has been launched, unsuspended or brought to the foreground, enables a near-end user of the device 2 to "dial" a telephone number or address of a communications device 4 of the far-end user (see FIG. 4), to initiate a call, and then to "hang up" the call when finished.

For wireless telephony, several options are available in the device 2 as depicted in FIG. 6. A cellular phone protocol may be implemented using a cellular radio 18 that transmits and receives to and from a base station 5 using an antenna 20 integrated in the device 2. As an alternative, the device 2 offers the capability of conducting a wireless call over a wireless local area network (WLAN) connection, using the Bluetooth/WLAN radio transceiver 15 and its associated antenna 17. The latter combination provides the added convenience of an optional wireless Bluetooth headset link. Packetizing of the uplink signal, and depacketizing of the downlink signal, for a WLAN protocol may be performed by the applications processor 19.

The uplink and downlink signals for a call that is conducted using the cellular radio 18 can be processed by a channel codec 16 and a speech codec 14 as shown. The speech codec 14 performs speech coding and decoding in order to achieve compression of an audio signal, to make more efficient use of the limited bandwidth of typical cellular networks. Examples of speech coding include half-rate (HR), full-rate (FR), enhanced full-rate (EFR), and adaptive multi-rate wideband (AMR-WB). The latter is an example of a wideband speech coding protocol that transmits at a higher bit rate than the others, and allows not just speech but also music to be transmitted at greater fidelity due to its use of a wider audio frequency bandwidth. Channel coding and decoding performed by the channel codec 16 further helps reduce the information rate through the cellular network, as well as increase reliability in the event of errors that may be introduced while the call is passing through the network (e.g., cyclic encoding as used with convolutional encoding, and channel coding as implemented in a code division multiple access, CDMA, protocol). The functions of the speech codec 14 and the channel codec 16 may be implemented in a separate integrated circuit chip, some times referred to as a baseband processor chip. It should be noted that while the speech codec 14 and channel codec 16 are illustrated as separate boxes, with respect to the applications processor 19, one or both of these coding functions may be performed by the applications processor 19 provided that the latter has sufficient performance capability to do so.

The applications processor 19, while running the telephony application program 30, may conduct the call by enabling the transfer of uplink and downlink digital audio signals (also referred to here as voice or speech signals) between itself or the baseband processor on the network side, and any user-selected combination of acoustic transducers on the acoustic side. The downlink signal carries speech of the far-end user during the call, while the uplink signal contains speech of the near-end user that has been picked up by the primary microphone 8. The acoustic transducers include an earpiece speaker 6 (also referred to as a receiver), a loud speaker or speaker phone (not shown), and one or more microphones including the primary microphone 8 that is intended to pick up the near-end user's speech primarily, and a secondary microphone 7 that is primarily intended to pick up the ambient or background sound. The analog-digital conversion interface between these acoustic transducers and the digital downlink and uplink signals is accomplished by an analog audio codec 12. The latter may also provide coding and decoding functions for preparing any data that may need to be transmitted out of the mobile device 2 through a connector (not shown), as well as data that is received into the device 2 through that connector. The latter may be a conventional docking connector that is used to perform a docking function that synchronizes the user's personal data stored in the memory 28 with the user's personal data stored in the memory of an external computing system such as a desktop or laptop computer.

Still referring to FIG. 6, an audio signal processor is provided to perform a number of signal enhancement and noise reduction operations upon the digital audio uplink and downlink signals, to improve the experience of both near-end and far-end users during a call. This processor may be viewed as an uplink processor 9 and a downlink processor 10, although these may be within the same integrated circuit die or package. Again, as an alternative, if the applications processor 19 is sufficiently capable of performing such functions, the uplink and downlink audio signal processors 9, 10 may be implemented by suitably programming the applications processor 19. Various types of audio processing functions may be implemented in the downlink and uplink signal paths of the processors 9, 10.

The downlink signal path receives a downlink digital signal from either the baseband processor (and speech codec 14 in particular) in the case of a cellular network call, or the applications processor 19 in the case of a WLAN/VOIP call. The signal is buffered and is then subjected to various functions, which are also referred to here as a chain or sequence of functions. These functions are implemented by downlink processing blocks or audio signal processors 21, 22 that may include, one or more of the following which operate upon the downlink audio data stream or sequence: a noise suppressor, a voice equalizer, an automatic gain control unit, a compressor or limiter, and a side tone mixer.

The uplink signal path of the audio signal processor 9 passes through a chain of several processors that may include an acoustic echo canceller 23, an automatic gain control block, an equalizer, a compander or expander, and an ambient noise suppressor 24. The latter is to reduce the amount of background or ambient sound that is in the talker signal coming from the primary microphone 8, using, for instance, the ambient sound signal picked up by the secondary microphone 7. Examples of ambient noise suppression algorithms are the spectral subtraction (frequency domain) technique where the frequency spectrum of the audio signal from the primary microphone 8 is analyzed to detect and then suppress what appear to be noise components, and the two microphone algorithm (referring to at least two microphones being used to detect a sound pressure difference between the microphones and infer that such is produced by speech of the near-end user rather than noise). The functional unit blocks of the noise suppression system depicted in FIG. 1 and described above, including its use of the different occlusion detectors described above, is another example of the noise suppressor 24.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the 2-mic noise estimator can also be used with multiple microphones whose outputs have been combined into a single "talker" signal, in such a way as to enhance the talkers voice relative to the background/ambient noise, for example, using microphone array beam forming or spatial filtering. This is indicated in FIG. 1, by the additional microphones in dotted lines. Also, while the occlusion detection was described using power or energy ratio (PR) as an independent variable of the occlusion function, an alternative is to formulate the occlusion function so that the independent variable is a magnitude ratio (MR) of the two microphone signals. Lastly, while FIG. 5 shows how the occlusion detection techniques can work with a pair of microphones that are built into the housing of a mobile phone device, those techniques can also work with microphones that are positioned on a wired headset or on a wireless headset. The description is thus to be regarded as illustrative instead of limiting.

What is claimed is:

1. An electronic system for audio noise processing and for noise reduction, using a plurality of microphones, comprising:

a first noise estimator to process a first audio signal from a first one of the microphones, and generate a first noise estimate;

a second noise estimator to process the first audio signal, and a second audio signal from a second one of the microphones, in parallel with the first noise estimator, and generate a second noise estimate;

a combiner-selector to receive the first and second noise estimates, and to generate an output noise estimate using the first and second noise estimates; and a microphone occlusion detector to process the first and second audio signals including to band pass filter the first and second audio signals and to generate a microphone occlusion signal using the processed first and second audio signals, wherein the microphone occlusion signal represents a measure of how severely or how likely it is that one of the microphones is occluded, and wherein the combiner-selector is to generate its output noise estimate also based on the occlusion signal.

2. The system of claim 1 wherein the combiner-selector selects the first noise estimate for its output noise estimate, and not the second noise estimate, when the occlusion signal indicates that the second one of the microphones is substantially occluded.

3. The system of claim 1 wherein the occlusion detector computes a power or energy ratio (PR) or a magnitude ratio (MR) of band pass filtered versions of the first and second audio signals, and evaluates an occlusion function at the computed PR or MR.

4. The system of claim 3 wherein the occlusion detector is to band pass filter the first and second audio signals over a pass band of about 2000Hz-4000Hz.

5. The system of claim 3 wherein when the PR or MR is greater than a threshold the occlusion function has a fixed value indicating substantial occlusion, and when the PR or MR is less than the threshold the occlusion function has a different fixed value that indicates no substantial occlusion.

6. The system of claim 3 wherein the PR is computed using the formula $$PR=pow1t-pow2t$$

where $$pow1t=10*\log 10\{[\text{summation of frame_mic1}(i)*\text{frame_mic1}(i)]/N\},$$

$$pow2t=10*\log 10\{[\text{summation of frame_mic2}(i)*\text{frame_mic2}(i)]/N\}$$

and where frame_mic1 and frame_mic2 include samples from i=1 to i=N of band pass filtered versions of the signals from the first and second microphones, or it is computed in the frequency domain by summation over a range of frequency bins.

7. The system of claim 6 wherein the PR is computed in dB.

8. The system of claim 1 wherein the occlusion detector further computes one or more of the following and uses them to generate the occlusion signal: absolute power of the second audio signal over a given time frame and over a range of frequency bins within the given time frame; the output noise estimate per frequency bin; and a VAD decision per frequency bin.

9. The system of claim 6 wherein the occlusion function is proportional to a logistic function C/(1+A*exp(−B*PR)) where A, B and C are scalar coefficients that define the slope, position and final magnitude of the logistic function.

10. A microphone occlusion detector comprising:

means for processing first and second audio signals that are from first and second microphones, respectively, including means for band pass filtering the signals; and means for evaluating a microphone occlusion function that represents a measure of how severely or how likely it is that the second microphone is occluded, using the processed first and second audio signals.

11. The occlusion detector of claim 10 wherein the processing means computes a power ratio (PR) or magnitude ratio (MR) of band pass filtered versions of the first and second audio signals in a pass band of about 2000Hz-4000Hz, and the occlusion function is a function of the PR or MR.

12. The occlusion detector of claim 11 wherein the occlusion function takes on a high value that indicates occlusion or greater occlusion when the PR or MR is greater than a threshold, and the occlusion function takes on a low value that indicates no occlusion or lesser occlusion when the PR or MR is less than the threshold.

13. The occlusion detector of claim 11 wherein the power ratio is computed using the formula $$PR=pow1t-pow2t$$

where $$pow1t=10*\log10\{[\text{summation of frame_mic1}(i)*\text{frame_mic1}(i)]/N\},$$

$$pow2t=10*\log 10\{[\text{summation of frame_mic2}(i)*\text{frame_mic2}(i)]/N\}$$

where frame_mic1 and frame_mic2 include samples from i=1 to i=N of band pass filtered versions of audio signals from the first microphone and the second microphone, or is computed in the frequency domain by summing power spectrum bins from start to stop where start and stop are the frequency bins that define the boundaries of the band pass filter pass band.

14. The occlusion detector of claim 10 wherein the occlusion function is proportional to a logistic function C/(1+A*exp(−B*PR)) where A, B and C are scalar coefficients that define the slope, position and final magnitude of the logistic function.

15. The occlusion detector of claim 14 further comprising: smoothing means for smoothing the logistic function.

16. A microphone occlusion detector that uses multiple occlusion component signals, comprising:

means for processing first and second audio signals that are from first and second microphones, respectively, including means for band pass filtering the signals;

means for evaluating a first occlusion component function that represents a measure of how severely or how likely it is that the second microphone is occluded during speech activity, using the band pass filtered first and second audio signals;

means for evaluating a second occlusion component function that represents a measure of how severely or how likely it is that the second microphone is occluded during no speech activity, using the band pass filtered first and second audio signals; and means for selecting between the first and second occlusion component functions, wherein in a no speech condition, the second component function is selected but not the first component function, and in a no speech condition where the level of background noise is at a high level, the first component function is selected but not the second compound function.

17. The occlusion detector of claim 16 wherein the audio signal processing means comprises a voice activity detector that indicates said no speech condition.

18. The occlusion detector of claim 16 wherein the audio signal processing means comprises means for computing absolute power of the second audio signal to indicate the level of background noise is at a low level.

19. The occlusion detector of claim 16 wherein the audio signal processing means comprises a background noise estimator.

20. The occlusion detector of claim 16 wherein each of the first and second occlusion component functions is a logistic function, each being a function of a power ratio (PR) or magnitude ratio (MR) of the first and second audio signals.

21. The occlusion detector of claim 20 wherein an inflection point of the first component function is at a lower PR or MR value than that of the second component function.

22. A method for detecting occlusion of a microphone, comprising:

processing band pass filtered versions of first and second audio signals that are from first and second microphones, respectively, to compute a power ratio (PR) or a magnitude ratio (MR) of the band pass filtered first and second signals; and evaluating an occlusion function, being a measure of how occluded the second microphone is, as a function of PR or MR, wherein the occlusion function is one of a) a curve that abruptly indicates substantial occlusion when the PR or MR is greater than a threshold, and abruptly indicates no substantial occlusion when the PR or MR is smaller than the threshold, b) a curve that gradually indicates increasing occlusion when the PR or MR is greater than a threshold, and abruptly indicates no substantial occlusion when the PR or MR is smaller than the threshold, and c) a logistic function.

23. The method of claim 22 wherein the occlusion function is the logistic function, the method further comprising smoothing the logistic function.

24. The method of claim 22 wherein the logistic function is smoothed using an exponential filter.

25. The method of claim 22 further comprising:

generating a noise estimate from the first audio signal and not the second audio signal, responsive to the evaluated occlusion function indicating more occlusion or occlusion present; and generating the noise estimate from both the first and second audio signals responsive to the evaluated occlusion function indicating less occlusion or occlusion absent.

* * * * *